US006450785B1

(12) United States Patent
Dellby et al.

(10) Patent No.: US 6,450,785 B1
(45) Date of Patent: Sep. 17, 2002

(54) OIL PUMP FOR A HERMETIC COMPRESSOR

(75) Inventors: Fredrik Dellby, Alvsjo (SE); Carlo Zonta, Mirano (IT)

(73) Assignee: Zanussi Elettromeccanica S.p.A., Pordenone (IT)

( * ) Notice: Subject to any disclaimer, the term of this patent is extended or adjusted under 35 U.S.C. 154(b) by 0 days.

(21) Appl. No.: 09/622,273

(22) PCT Filed: Jun. 4, 1999

(86) PCT No.: PCT/EP99/03867

§ 371 (c)(1),
(2), (4) Date: Aug. 14, 2000

(87) PCT Pub. No.: WO00/01949

PCT Pub. Date: Jan. 13, 2000

(30) Foreign Application Priority Data

Jul. 1, 1998 (IT) ..... PN98U0036

(51) Int. Cl.[7] ..... F04B 17/00; F04B 35/04

(52) U.S. Cl. ..... 417/410.3; 417/372; 417/423.13; 184/6.16; 184/6.18; 415/111; 415/113; 415/175; 415/176

(58) Field of Search ..... 417/372, 423.13, 417/228, 902, 410.3; 184/6.16, 6.18; 415/111, 113, 175, 176

(56) References Cited

FOREIGN PATENT DOCUMENTS

EP 0728946 A1 * 8/1996

WO WO 93/22557 * 11/1993

* cited by examiner

*Primary Examiner*—Charles G. Freay
*Assistant Examiner*—William H Rodriguez
(74) *Attorney, Agent, or Firm*—Pearne & Gordon LLP

(57) ABSTRACT

A hermetic motor compressor unit for household and similar refrigeration appliances, comprising a sealed casing having a bottom that forms a sump for holding lubricating oil. Inside of the casing is a compressor and driving motor that share a common hollow crankshaft that rotates about a vertical axis. To ensure effective lubricating oil flow into the hollow crankshaft, a means for providing suction comprising a sleeve is rigidly fixed to the lower end portion of the crankshaft. A fluted member made of a material with a lower thermal conductivity than the material from which the hollow crankshaft is made that is connected to the stator of the drive motor is inserted into the sleeve to draw the lubricating oil from the sump. The lubricating oil is drawn in from the oil sump into recesses in the fluted member when the sleeve is rotated into the position in which it allows the recesses to communicate with lower apertures in the sleeve. This occurs during the downstroke of the fluted member. When the sleeve is then rotated by an angle of approximately 90° with respect to the above mentioned position, the oil is able to flow from the recesses through the upper apertures into the hollow crankshaft during the upstroke of the fluted member.

7 Claims, 3 Drawing Sheets

OIL PUMP FOR A HERMETIC COMPRESSOR

BACKGROUND OF THE INVENTION

1. Field of the Invention

The present invention refers to a hermetic refrigeration motor compressor unit, in particular for use in household-type refrigeration appliances.

2. Description of the Related Art

The actual refrigeration compressor (which is usually of the reciprocating or rotary type) and the related electric driving motor are generally known to have a common shaft and to be enclosed in a sealed casing. Owing to the resulting impossibility for any kind of maintenance to be carried out subsequently, it is imperative for an effective, continuous and reliable lubrication of the moving parts of such a hermetically sealed unit to be assured throughout the operating life span, which may amount to as many as more than 15 years, of the refrigeration appliance in which such a unit is mounted.

To this purpose, the hermetic motor compressor unit comprises means that are adapted to ensure, during the operating periods thereof. an adequate flow of the oil that is filled in an appropriate quantity in the sealed casing at the end of the compressor manufacturing cycle, in such a manner as to enable it to not only lubricate said moving parts, but also prevent them from overheating.

It is a generally known practice for the above mentioned means to be provided in the form of a downward extension of the shaft, that is longitudinally bored and shaped so as to be capable of drawing in the oil from the bottom of the sealed casing and diffusing it, substantially by centrifugal effect, into the parts to be lubricated. Such a construction is usually effective in the case of traditional hermetic motor compressor units that are equipped with a single-phase two-pole induction motor operating at 2700 to 3000 rpm.

However, hermetic motor compressor units are increasingly being used since a few years now, which are equipped with electric direct-current brushless motors that are capable of operating at adjustable speeds varying from a maximum that may reach as many as 4000 rpm to a minimum that may on the contrary be as low as 1000 rpm or even less, to the purpose of optinizing the performance of the related refrigeration appliance, particularly from an energy usage point of view.

Hermetic motor compressor units are also known which are equipped with a four-pole induction motor operating at a speed of only 1500 rpm so that, for a same refrigeration capacity or output, a greater displacement of the compressor is needed.

In both above cited cases, the traditional lubrication and cooling means as the afore mentioned ones are largely inadequate owing to the fact that the low rotational speeds of the shaft do not ensure any adequate delivery head and flow rate of the oil sucked in from the bottom of the sealed casing, or a thorough diffusion of the same oil to all parts that need to be lubricated.

In a hermetic motor compressor unit in which the electric driving motor is arranged below the compressor, it has been proposed that a worm-screw member be inserted with a slight radial gap in the hollow shaft starting from the lower end thereof (see document WO 96/29516). The relative movement between the shaft and the worm-screw member, which extends along the entire electric driving motor and is retained by a support being fixed to the stator of the motor, ensures the desired oil flow. This solution has however a drawback in that is the helical insert is completely contained inside the shaft and is affected by the heat transmitted by the motor. As a result, mutual expansions tend to take place during the operation of the motor compressor unit, which cause the radial gap between the insert and the shaft to be altered, under corresponding variations in the lubrication performance.

It has been also proposed that a pumping chamber with a worm-screw member attached protrudingly to the lower end portion of the shaft and a therewith associated stationary sleeve (see documents WO 93/22557 and EP-A-0 728 946) be provided in the motor compressor unit. This kind of solution causes a further radial gap to be created between the stationary sleeve and the inner surface of the rotating shaft, so that leakages unavoidably take place owing to oil seeping through said gap, with the result of a reduced flow rate of the oil being pumped. Furthermore, a solution of this kind proves quite difficult and expensive to implement, since care shall duly be taken to ensure, between the two component parts of the pumping chamber, not only the afore mentioned circumferential gap, but also a gap on the horizontal plane between the sleeve and the lower end portion of the shaft in view of preventing said parts from undergoing a weardown effect brought about by friction during operation.

BRIEF SUMMARY OF THE INVENTION

Patent Abstracts of Japan vol. 009, no. 275 (M-426), Nov. 2, 1985 (1985-11-02) & JP 60 119389 A (Toshiba KK), Jun. 26, 1985 (1985-06-26) disclose a lubricating system also comprised of a fixed helically grooved (fluted) element, which can also be considered to be connected elastically with the stator. However, in said documents a separate rotating sleeve fully outside the rotor is not provided, but rather a rotating hollow motor shaft is utilized as part of the oil suction means. Therefore, the oil suction means are not fully outside the rotor shaft, because the fixed element is inserted within the rotor shaft. Such a solution is affected by serious heat transfer problems.

It therefore is a main purpose of the present invention to provide, through the use of simple, reliable and low-cost means, an improved hermetic motor compressor unit that is capable of ensuring an effective oil flow even at operating speeds thereof that may be as low as approx. 800 rpm.

As this will be better explained further on, this and further aims are reached in a hermetic motor compressor unit provided with an oil suction arrangement featuring the characteristics as recited in the appended claims.

Anyway, such features, along with the advantages of the present invention, will be more readily understood from the description that is given below by way of non-limiting example with reference to the accompanying drawings, in which:

DETAILED DESCRIPTION OF THE INVENTION

Figure 1:
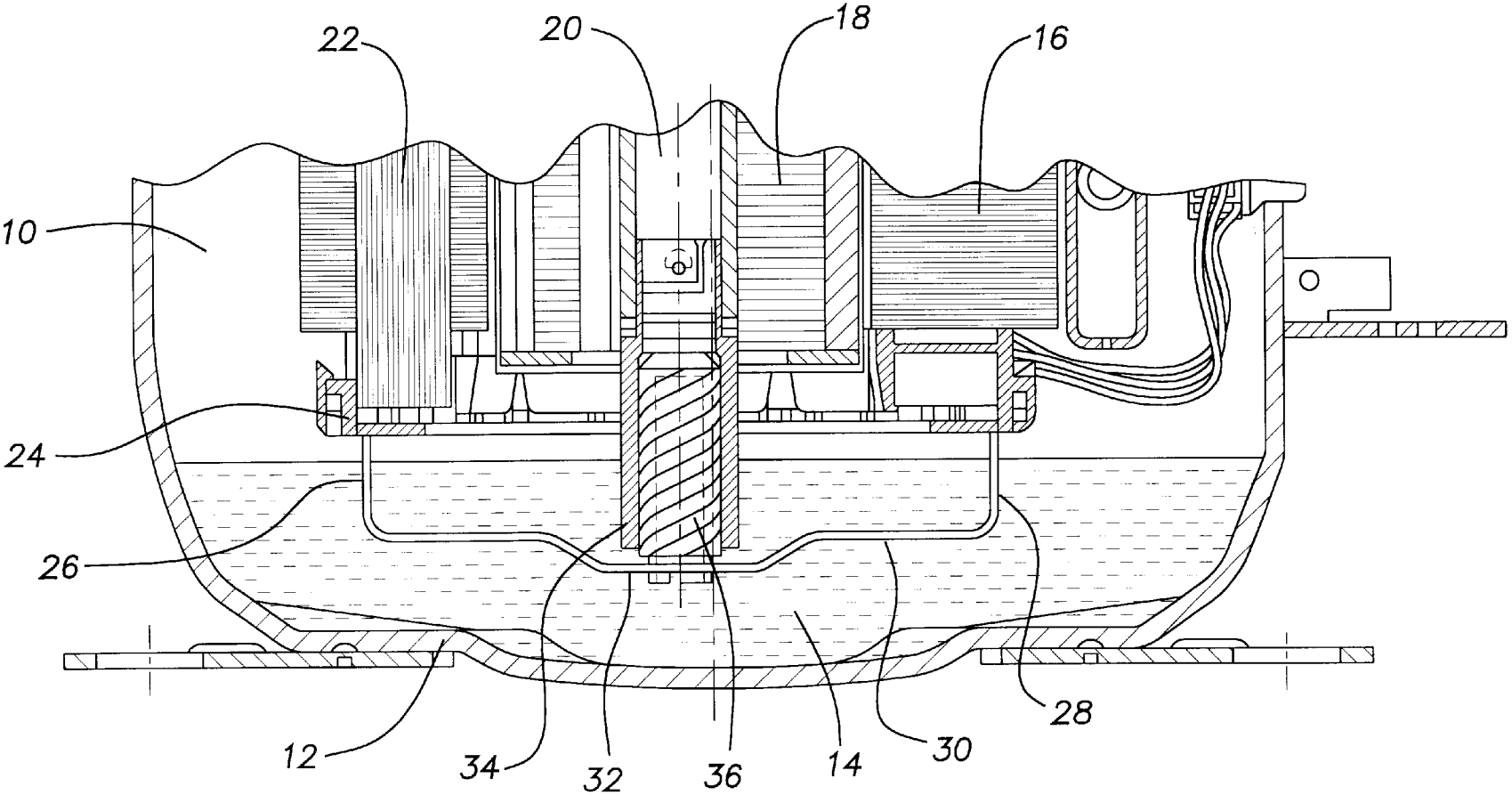
FIG. 1 is a cross-sectional view along a vertical plane of the lower portion of a hermetic motor compressor unit comprising the oil suction arrangement according to the present invention, in a first embodiment thereof.

With reference to FIG. 1, it can be noticed that the items and details of the hermetic motor compressor unit that are of no relevance to the purposes of the present invention, starting from the actual compressor, are not shown since considered to be largely known to all those skilled in the art.

A metal sealed casing 10 has a lower portion 12 that forms the sump in which the oil 14 collects which, filled in during compressor manufacturing, ensures the lubrication of the moving parts of an electric driving motor 16 and a compressor situated thereabove that may for instance be of the reciprocating type.

In this particular embodiment. the motor 16 is of the direct-current brushless type with a permanent-magnet rotor 18 fixed to a vertical hollow shaft (which is common to the compressor situated thereabove) and a similar stator 22. The lower portion of the stator comprises a shroud 24 that supports (with the aid of a pair of slots that are not shown in the Figure for reasons of greater simplicity) the end portions 26 and 28 of a bracket 30 that is preferably made out of spring-steel rod. As it can be noticed, this bracket 30 is substantially in the shape of a U with a recessed central zone 32.

Fixed to the lower end portion of the hollow shaft 20 there is a sleeve 34 that extends further vertically into the sump 10 so as to be able to plunge into and draw from the lubrication oil 14 collected therein. The sleeve 34 is adapted to rotate jointly with the hollow shaft 20.

Inserted inside the sleeve 34 there is an oil suction member 36 which is provided, on its outer surface, with a helical groove that advantageously extends throughout, ie. covers the entire length of the same member. This groove, by cooperating with the inner wall of the sleeve 34, forms a channel ensuring the passage of the oil 14 from the sump 10 to the interior of the shaft 20.

The sleeve 34 and the fluted member 36 are preferably made of plastic material, ie. a material with a lower heat conductivity than the one of the metal material used to make the hollow shaft 20 itself. This solution is clearly simpler and less expensive as far as both the construction itself and the assembly are concerned. It furthermore enables the problems associated to the mutual thermal expansion of the sleeve and the fluted member to be largely eliminated. Conclusively, the performance and reliability characteristics of the whole hermetic motor compressor unit are improved, according to the actual purpose of the present invention.

The fluted member 36 is sustained by the elastic bracket 30, whose central zone 32 inserts freely in a notch provided in the lower head portion of the member 36. This type of elastic assembly enables the member 36 to float, but not rotate, inside the sleeve 34 during the operation of the motor compressor unit, thereby enabling possibly occurring misalignments of the shaft 20 and the oil suction arrangement to be compensated for.

Figure 2:
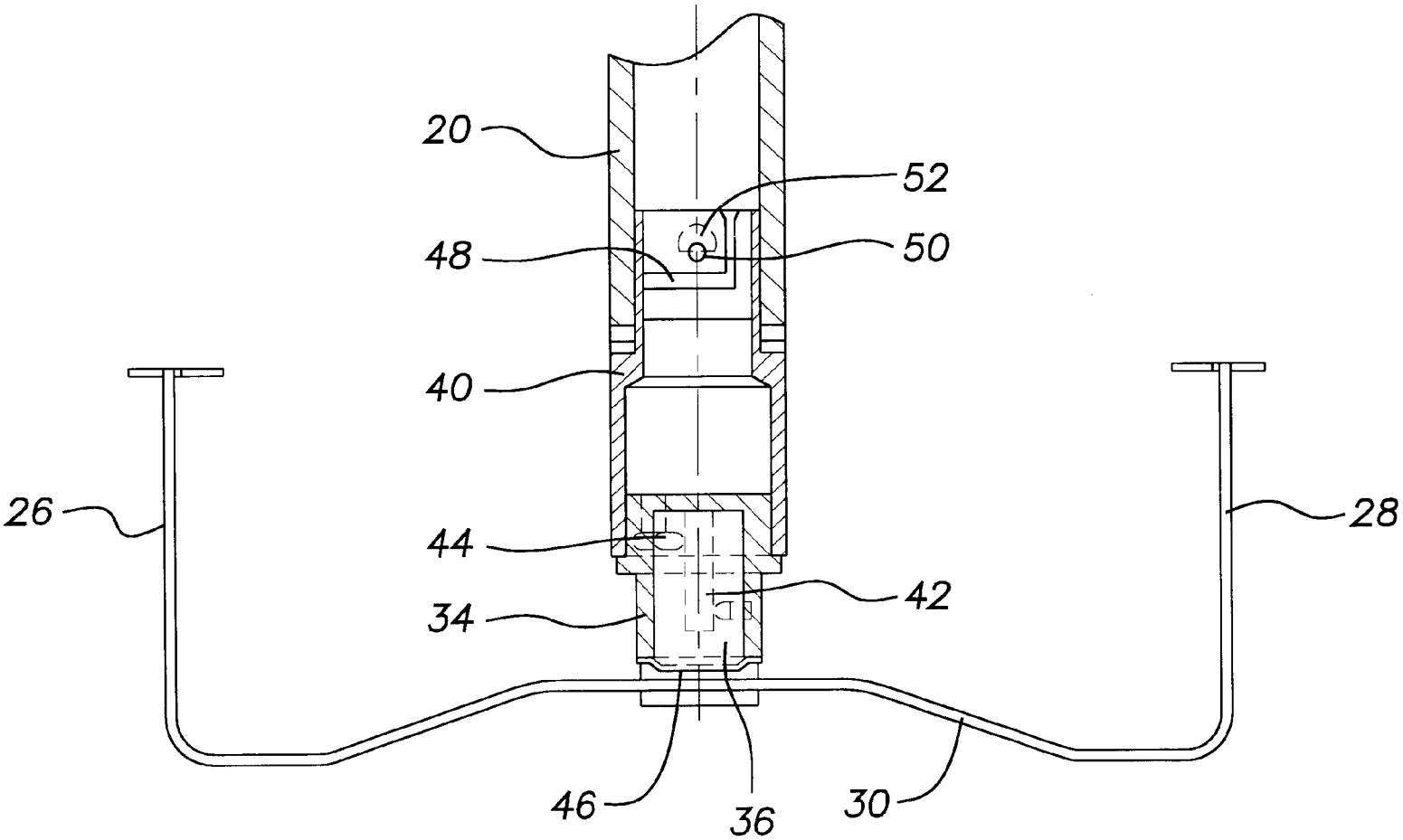
FIG. 2 is a similar view as the one illustrated in FIG. 1, but showing only the oil suction arrangement in a second embodiment thereof.
Figure 3:
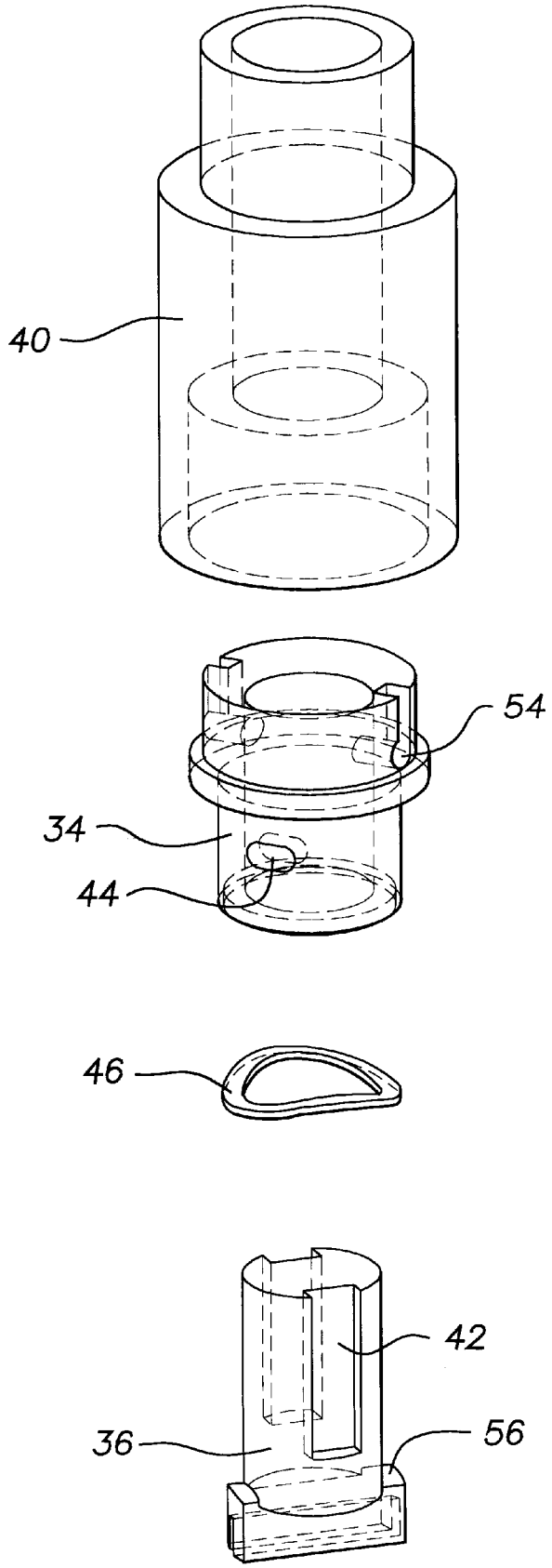
FIG. 3 is an exploded view of the component parts of the oil suction arrangement shown in FIG. 2.

A second embodiment of the present invention, which is based on the same operating principle and ensures practically the same level of effectiveness as the afore described embodiment, is illustrated in FIGS. 2 and 3, in which the same reference numerals are used to indicated items and details corresponding to the ones illustrated in FIG. 1. As a result, to the lower end portion of the shaft 20 there is again fixed a sleeve 34, in this case however via an extension 40 of the same shaft. In the sleeve 34 there is inserted a floating piston member 36 that is sustained by the elastic bracket 30 whose end portions 26 and 28 are connected to the shroud of the motor 16, as this is shown in FIG. 1.

The constuction-related difference lies in the fact that the floating member 36 (FIG. 2) is provided in its outer surface with two axial and diametrically opposed recesses 42 that cooperate with corresponding apertures 44 and 54 which are provided at respective levels and pass through the wall of the sleeve 34. Furthermore, a undulated cam-profiled spring washer 46 is mounted between the member 36 and the sleeve 34. This cam-profiled washer 46 is fixed to the sleeve 34, preferably by bonding, and is adapted to act against a cross extension 56 that is provided at the lower end portion of the member 36. This extension 56 is in turn provided with a downward open notch, in which the elastic bracket 30 sustaining the oil suction arrangement is able to insert freely.

The attachment of the extension 40 to the shaft 20 (see FIG. 2) is brought about simply by press-fitting the two parts together, thanks to the ability of the upper end portion of the extension 40 to deform owing to the presence of a notch 48, as well as to a button 50 engaging a recess 52. The button 50 and the recess 52 are provided on the outer surface of the extension 40 and the inner surface of the shaft 20, respectively.

During the operation of the unit, when the shaft 20 rotates jointly with the extension 40 and the sleeve 34, the cam-profiled washer 46 acts against the extension 56 and pushes the piston-like member 36 downwards against the action of the elastic bracket 30 that tends to bias, ie. push the member 36 upwards. As a result, thanks to the combined effect of the curvature of the washer 46 and the elasticity of the bracket 30, the rotation of the shaft 20 is able to bring about a reciprocating movement of the member 36 in a vertical direction.

The lubricating oil 14 is drawn in from the oil sump 10 into the recesses 42 of the piston-like member 36 when the sleeve 34 is rotated into the position in which it allows the recesses 42 to communicate with the lower apertures 44. This occurs during the downstroke of the member 36. When the sleeve 34 is then rotated by an angle of approx. 90° with respect to the above mentioned position, the oil 14 is able to flow from the recesses 42 through the upper apertures 54 into the hollow shaft 20. This occurs during the upstroke of the member 36.

The described solution therefore constitutes an effective positive-displacement piston pump without moving valves.

What is claimed is:

1. A hermetic motor compressor unit for household and similar refrigeration appliances, comprising a sealed casing (10) having a bottom that forms a sump for lubricating oil (14), said casing receiving a compressor and driving motor (16), said compressor and motor sharing a common hollow crankshaft (20) that rotates about a vertical axis, lubricating oil suction means (34, 36) being provided at a lower end portion of said crankshaft, wherein said oil suction means comprises a sleeve (34) that is rigidly fixed to the lower end portion of the crankshaft (20) and in which a fluted member (36) is inserted, said fluted member being elastically connected to a stator (22) of the motor (16), wherein said fluted element (36) is a piston-like member that is provided on its outer surface with axial, mutually opposed recesses (42) that are adapted to cooperate with corresponding radial apertures (44, 54) provided at respective different levels passing through the wall of said sleeve (34), said oil suction means extending downwards fully outside said hollow crankshaft (20), said sleeve (34) and said fluted member (36) being made of a material having a lower thermal conductivity than a material from which the hollow shaft (20) is made.

2. The hermetic motor compressor unit according to claim 1 wherein, at the lower end portion of said sleeve (34) there is fixed an undulated cam-profiled spring washer (46) that cooperates with a cross extension (56) of said piston-like member (36).

3. A hermetic motor compressor unit for household and similar refrigeration appliances, comprising a sealed casing (10) having a bottom that forms a sump for lubricating oil (14), said casing receiving a compressor and driving motor (16), said compressor and motor sharing a common hollow crankshaft (20) that rotates about a vertical axis, lubricating oil suction means (34, 36) being provided at a lower end portion of said crankshaft, wherein said oil suction means comprises a sleeve (34) that is rigidly fixed to the lower end portion of the crankshaft (20) and in which a fluted member (36) is inserted, wherein, at the lower end portion of said sleeve (34) there is fixed an undulated cam-profiled spring washer (46) that cooperates with a cross extension (56) of said fluted member (36), said fluted member being elastically connected to a stator (22) of the motor (16), said oil suction means extending downwards fully outside said hollow crankshaft (20), said sleeve (34) and said fluted member (36) being made of a material having a lower thermal conductivity than a material from which the hollow shaft (20) is made.

4. A hermetic motor compressor unit for household and similar refrigeration appliances, comprising a sealed casing (10) having a bottom that forms a sump for lubricating oil (14), said casing receiving a compressor and driving motor (16), said compressor and motor sharing a common hollow crankshaft (20) that rotates about a vertical axis, lubricating oil suction means (34, 36) being provided at a lower end portion of said crankshaft, wherein said oil suction means comprises a sleeve (34) that is rigidly fixed to the lower end portion of the crankshaft (20) and in which a fluted member (36) is inserted, said fluted member being elastically connected to a stator (22) of the motor (16) and being sustained by a substantially U-shaped bracket (30) formed by a metal wire or strip, an intermediate zone (32) of said U-shaped bracket engages the lower end portion of the fluted member, and side arms (26, 28) of said U-shaped bracket are anchored to the stator (22) of the electric motor(16), wherein said fluted element (36) is a piston-like member that is provided on its outer surface with axial, mutually opposed recesses (42) that are adapted to cooperate with corresponding radial apertures (44, 54) provided at respective different levels passing through the wall of said sleeve (34), said oil suction means extending downwards fully outside said hollow crankshaft (20), said sleeve (34) and said fluted member (36) being made of a material having a lower thermal conductivity than a material from which the hollow shaft (20) is made.

5. A hermetic motor compressor unit for household and similar refrigeration appliances, comprising a sealed casing (10) having a bottom that forms a sump for lubricating oil (14), said casing receiving a compressor and driving motor (16), said compressor and motor sharing a common hollow crankshaft (20) that rotates about a vertical axis, lubricating oil suction means (34, 36) being provided at a lower end portion of said crankshaft, wherein said oil suction means comprises a sleeve (34) that is rigidly fixed to the lower end portion of the crankshaft (20) and in which a fluted member (36) is inserted, wherein, at the lower end portion of said sleeve (34) there is fixed an undulated cam-profiled spring washer (46) that cooperates with a cross extension (56) of said fluted member, said fluted member being elastically connected to a stator (22) of the motor (16) and being sustained by a substantially U-shaped bracket (30) formed by a metal wire or strip, an intermediate zone (32) of said U-shaped bracket engages the lower end portion of the fluted member, and side arms (26, 28) of said U-shaped bracket are anchored to the stator (22) of the electric motor (16), said oil suction means extending downwards fully outside said hollow crankshaft (20), said sleeve (34) and said fluted member (36) being made of a material having a lower thermal conductivity than a material from which the hollow shaft (20) is made.

6. A hermetic motor compressor unit for household and similar refrigeration appliances, comprising a sealed casing (10) having a bottom that forms a sump for lubricating oil (14), said casing receiving a compressor and driving motor (16), said compressor and motor sharing a common hollow crankshaft (20) that rotates about a vertical axis, lubricating oil suction means (34, 36) being provided at a lower end portion of said crankshaft, wherein said oil suction means comprises a sleeve (34) that is rigidly fixed to the lower end portion of the crankshaft (20) and in which a fluted member (36) is inserted, wherein said fluted member (36) is a member that is provided on its outer surface with a helical groove forming the channel for the compressor lubricating oil (14) to pass therethrough, said fluted member being elastically connected to a stator (22) of the motor (16) is a piston-like member that is provided on its outer surface with axial, mutually opposed recesses (42) that are adapted to cooperate with corresponding radial apertures (44, 54) provided at respective different levels passing through the wall of said sleeve (34), said oil suction means extending downwards fully outside said hollow crankshaft (20), said sleeve (34) and said fluted member (36) being made of a material having a lower thermal conductivity than a material from which the hollow shaft (20) is made.

7. A hermetic motor compressor unit for household and similar refrigeration appliances, comprising a sealed casing (10) having a bottom that forms a sump for lubricating oil (14), said casing receiving a compressor and driving motor (16), said compressor and motor sharing a common hollow crankshaft (20) that rotates about a vertical axis, lubricating oil suction means (34, 36) being provided at a lower end portion of said crankshaft, wherein said oil suction means comprises a sleeve (34) that is rigidly fixed to the lower end portion of the crankshaft (20) and in which a fluted member (36) is inserted, said fluted member provided on its outer surface with a helical groove forming the channel for the compressor lubrication oil (14) to pass therethrough being elastically connected to a stator (22) of the motor (16), said oil suction means extending downwards fully outside said hollow crankshaft (20), said sleeve (34) and said fluted member (36) being made of a material having a lower thermal conductivity than a material from which the hollow shaft (20) is made, wherein, at the lower end portion of said sleeve (34) there is fixed an undulated cam profiled spring washer (46) that cooperates with a cross extension (56) of said fluted member (36).

* * * * *

UNITED STATES PATENT AND TRADEMARK OFFICE

CERTIFICATE OF CORRECTION

PATENT NO. : 6,450,785 B1
DATED : September 17, 2002
INVENTOR(S) : Fredrik Dellby et al.

It is certified that error appears in the above-identified patent and that said Letters Patent is hereby corrected as shown below:

Column 2,
Line 2, please delete the first occurrence of "is".
Line 62, please delete "thereof,", and insert therefor -- thereof; --.

Column 4,
Line 7, after "respective", please insert -- different --.

Column 5,
Line 2, after "1", please insert -- , -- (comma).

Column 6,
Line 59, please delete "cam profiled", and insert therefor -- cam-profiled --.

Signed and Sealed this

Twenty-eighth Day of January, 2003

JAMES E. ROGAN
*Director of the United States Patent and Trademark Office*